US005447482A

United States Patent [19]

Kusel

[11] Patent Number: 5,447,482

[45] Date of Patent: Sep. 5, 1995

[54] BODY CONDITIONING DEVICE

[76] Inventor: Thomas Kusel, 161 Palm Ave., Auburn, Calif. 95603

[21] Appl. No.: 225,156

[22] Filed: Apr. 7, 1994

[51] Int. Cl.[6] ..... A63B 21/065

[52] U.S. Cl. ..... 482/105; 482/139; 482/98; 2/319; 2/338

[58] Field of Search ..... 482/105, 124, 139, 148, 482/908, 98, 99; 602/32; 2/2.15, 312, 319, 321, 322, 338; 273/32 D, 32 E; D2/627, 639; D3/215

[56] References Cited

U.S. PATENT DOCUMENTS

| | | | |
|---|---|---|---|
| 284,903 | 8/1986 | Rose . | |
| 338,997 | 9/1993 | Greco . | |
| 1,418,371 | 6/1922 | Foster . | |
| 2,970,448 | 2/1961 | DiJulio | 482/105 |
| 3,039,273 | 6/1962 | Swindell | 482/105 |
| 3,401,529 | 9/1968 | Fifield | 482/105 |
| 3,664,560 | 5/1972 | Perkins . | |
| 3,808,824 | 5/1974 | Johnston et al. . | |
| 3,888,245 | 6/1975 | Berntson et al. . | |
| 4,239,211 | 12/1980 | Wilkerson | 432/105 |
| 4,440,525 | 4/1984 | Perla . | |
| 4,561,652 | 12/1985 | Wilkinson | 482/105 |
| 4,592,358 | 6/1986 | Westplate | 482/105 |
| 4,623,143 | 11/1986 | Wuellenweber | 482/105 |
| 4,632,389 | 12/1986 | Moss | 482/105 |
| 4,732,305 | 3/1988 | Courtney et al. . | |
| 4,789,270 | 12/1988 | Selisky | 482/105 |
| 4,798,497 | 1/1989 | Bloos . | |
| 4,848,965 | 7/1989 | Peterson | 482/105 |
| 4,997,183 | 3/1991 | Winston | 482/105 |
| 5,076,575 | 12/1991 | Eylander . | |
| 5,106,082 | 4/1992 | Moschetti et al. | 482/105 |
| 5,120,288 | 6/1992 | Sinaki | 482/105 |
| 5,127,891 | 7/1992 | Winston | 482/105 |
| 5,162,027 | 11/1992 | Robinson | 482/105 |
| 5,242,348 | 9/1993 | Bates | 482/105 |
| 5,337,417 | 8/1994 | Whiteside et al. | 2/338 |

*Primary Examiner*—Richard J. Apley
*Assistant Examiner*—Victor K. Hwang
*Attorney, Agent, or Firm*—Bielen, Peterson & Lampe

[57] ABSTRACT

A body conditioning device utilizing a base member having a first surface and a second opposite surface. The base member includes a padded core between the first and second surfaces. The first surface provides a recess portion which is capable of at least partially positioning weights. The weights are held to the base member by a strap which is extendable along the base member. The strap and base member form a unit by feeding the strap through a plurality of holding slots in the base member. The weights may be positioned at the front and back of a user when the strap is looped about the waist portion of the user, and held in such a configuration by a clasp.

8 Claims, 2 Drawing Sheets

BODY CONDITIONING DEVICE

BACKGROUND OF THE INVENTION

The present invention relates to a novel and useful body conditioning device which may be worn as a weighted belt about the waist of the user.

Belts have been employed in many cases in the past to support the user and to carry items. U.S. Pat. No. 1,418,371, U.S. Pat. Nos. Des. 284,903, 338,997, and U.S. Pat. No. 3,664,560 show belt systems which are employed to carry items such as money, tape cassettes, firearms, and the like.

Other belt systems have been employed in the diving arts to hold weights which are necessary to achieve neutral buoyancy. For example, U.S. Pat. Nos. 3,808,824, 4,440,525, 4,732,305, and 5,076,575 describe diver weight belts which are employed to hold weights by looping a belt through the weight structure or by a series of pockets attached to a belt. U.S. Pat. No. 4,798,497 shows a belt system utilizing a series of rounded cylindrical weights which are looped on a belt that has a clasp at one end. The weights are movable along the belt and positioned by frictional engagement with the belt.

Exercising regularly is known to improve the musculature and cardiovascular aspects of the user. It is also important that correct spinal posture be maintained during exercise activities. Many lower back injuries result from improper exercising techniques and lack of leg strength. In this regard, U.S. Pat. No. 3,888,245 describes a surgical belt which is intended to relieve certain lower back pains. This patent includes a weighted pocket on the belt which is intended to lie above the sacral and coccygeal vertebrae of the user.

A body conditioning device worn about the waist which provides lower back support to the user and permits the distribution of weight in the forward and back positions would be a notable advance in the conditioning and exercising fields.

SUMMARY OF THE INVENTION

In accordance with the present invention a novel and useful body conditioning device is provided that may be worn about the waist of the user.

The body conditioning device of the present invention includes a base member having a first surface and second surface which is opposite to the first surface. The base member possesses a padded core between the first and second surfaces. The body core further includes a recess portion which may take the form of a number of adjacent cavities or a single recessed channel along the first surface of the base member. The base member includes a padded core between the first and second surfaces to provide support to the user's waist region when the base member is cinched. In addition, the base member may be constructed with end portions that are easily trimmed in order to conform to the girth of a particular user. The base member may also be formed with slots adjacent or within the recess portion thereof.

A strap is also employed in the present invention and extends along the first surface of the base member at the recess portion of the base member. The strap may be confined to the base member by looping the same through the slots found in the base member, which serves as holding means. In addition, the strap may include a clasp at its end portions capable of forming a closed loop around the waist of the user and to apply pressure to the base member, and, thus, to support the user of the device of the present invention.

Weight means is also found in the present invention for applying a force generally in a downward direction. Such weight means includes at least one weight carried by the strap and positions to lie at least partially in the recess portion of the base member. In the case where a plurality of weights are employed, the weights may be positioned along the first surface of the base member and separated in groups to provide a front and back downward pressure on the user of the device of the present invention. Each of the weights used may take an eccentric shape, such as the shape of a triangular prism, to permit adjustment of the distribution of such weights in a vertical position. Clips or glides may be employed to prevent movement of the weights along the strap. Such glides or clips serve as means for limiting the travel of the weights relative to the strap.

It may be apparent that a novel and useful body conditioning device has been herein described.

It is thus an object of the present invention to provide a body conditioning device which is usable in conducting exercises which are intended to strengthen the leg muscles of the body.

It is another object of the present invention to provide a body conditioning device which improves the cardiovascular system of the user.

Yet another object of the present invention is to provide a body conditioning device which regulates the postural attitude of the lumbar spine of the user while exercising.

A further object of the present invention is to provide a body conditioning device which is worn about the waist of the user and includes the provision of weights of varying sizes that may be positioned in front and back positions on the device.

Yet another object of the present invention is to provide a body conditioning device which includes the provision of weights that are easily nested along a waist encircling strap.

Another object of the present invention is to provide a body conditioning device that possesses a plurality of weights which may be variably positioned along a waist encircling belt horizontally and vertically.

A further object of the present invention is to provide a body conditioning device which loads the leg muscles of the user and is adjustable to fit the particular girth of the user.

Another object of the present invention is to provide a body conditioning device which can be used to strengthen the muscles of the lower torso in support of the lumbar spine.

The invention possesses other objects and advantages especially as concerns particular characteristics and features thereof which will become apparent as the specification continues.

Figure 1:
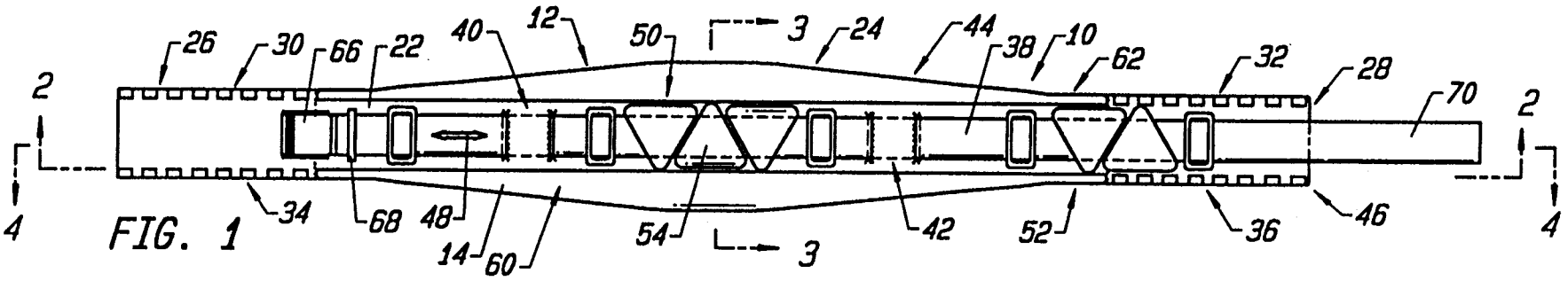
FIG. 1 is a rear elevational view of the invention of the device of the present invention.
Figure 2:
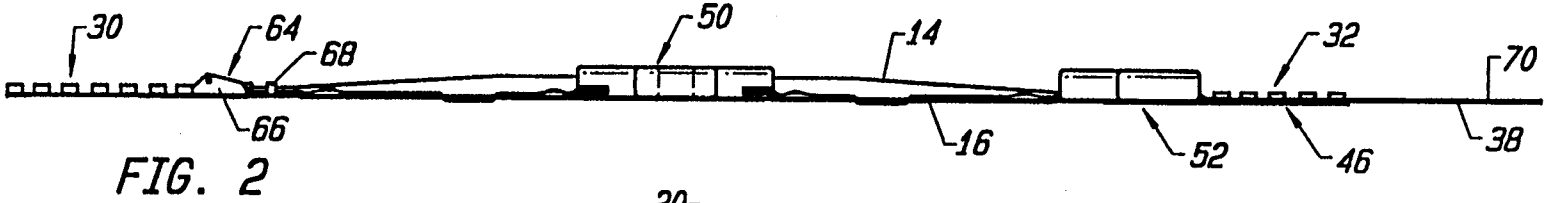
FIG. 2 is a sectional view taken along line 2—2 of FIG. 1.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments which should be referenced to the hereinbefore described drawings.

The invention as a whole is depicted in the drawings by reference character 10. The body conditioning device 10 includes as one of its elements a base member 12 which includes a first surface 14 and an opposite second surface 16, shown most clearly in FIG. 3. A padded core 18 lies between first and second surfaces 14 and 16. Padded core 18 may be formed of a laminated resilient foam plastic material and the like. Core 18 may be enclosed by a fabric cover 20, depicted on FIG. 3, however core 18 may be formed without such cover 20.

Base member 12 is also provided with recess portion 22 which extends as a channel along first surface 14 of base member 12. The recess portion 22 may take other formats such as a series of open pockets or cavities along first surface 14. Base member 12 also is formed with a widened portion 24 and end portion 26 and 28. End portions 26 and 28 include a group of protuberances 30 and 34, and 32 and 36, respectively. With respect to end portion 28, for example, severing cuts may be made between special adjacent protuberances of plurality of protuberances 32, and between adjacent protuberances of plurality of protuberances 36, to shorten the length of base member 12. A similar shortening procedure may be accomplished with respect to end portion 26.

The present invention also includes strap 38 which passes through pairs of slots 40 and 42 through base member 12. Strap 38 may take the form of webbing formed of material such as nylon. Strap 38 is also capable of lying in the vicinity of recess portion 22 of base member 12. Thus, pairs of slots 40 and 42 serves as means 44 for confining the strap 38 to base member 12 to form a unit 46. It should be noted that directional arrow 48 indicates that strap 38 is movable laterally relative to base member 12 in order to adapt strap 38 to the ultimate length of base member 12.

Figure 3:
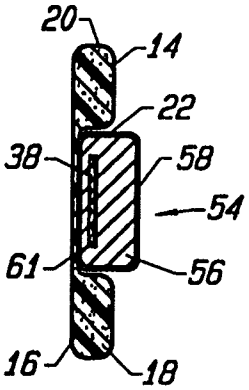
FIG. 3 is a sectional view taken along line 3—3 of FIG. 1.

Weight means 50 is employed in the present invention to apply a force on base member 12, normally in the downward direction. Weight means is illustrated in the drawings as taking the form of a plurality of weights 52, each being eccentrically shaped in the form of a triangular prism. With reference to FIG. 3, weight 54 is shown and exhibits a metallic core 56 coated with a soft and, optionally, resilient vinyl material 58. A slot 61 passes through core 56 and cover 58 to permit strap 38 to thread its way through the same. Plurality of weights 52 may be alternated with the large portion oriented upwardly and downwardly as depicted on FIG. 1. Thus, plurality of weights 52 are capable of nesting closely with respect to one another along strap 38. Stop means 60 is also employed and takes the form of a plurality of clips or triglides 62. Triglides 62 prevent the movement of plurality of weights 52 along strap 38 when plurality of weights are threaded on strap 38. Fastening means 64 is also found in the present invention and is illustrated as a conventional clasp 66 lockable with strap 38. D-ring 68 is capable of enclosing the bitter end 70 of strap 38.

Figure 5:
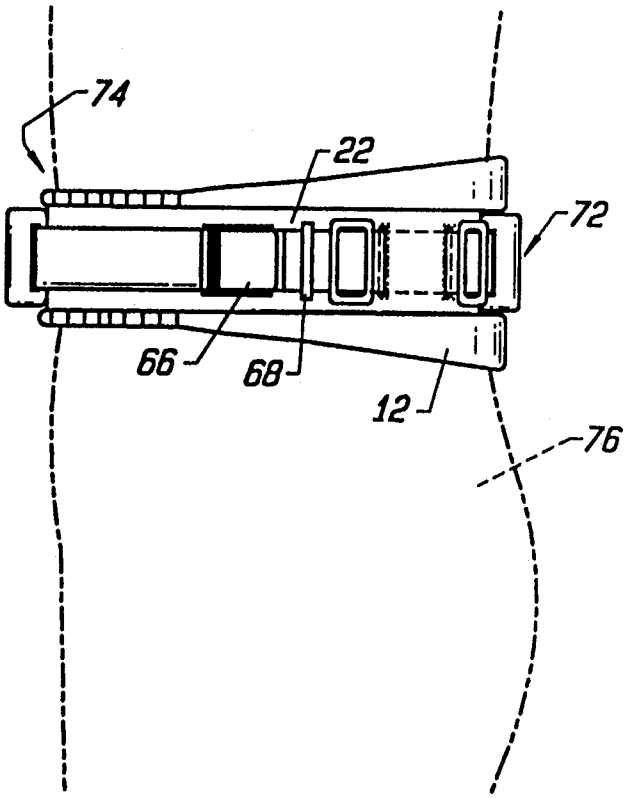
FIG. 5 is a side elevational view of the device of FIG. 1 in place around the waist of the user.
Figure 4:
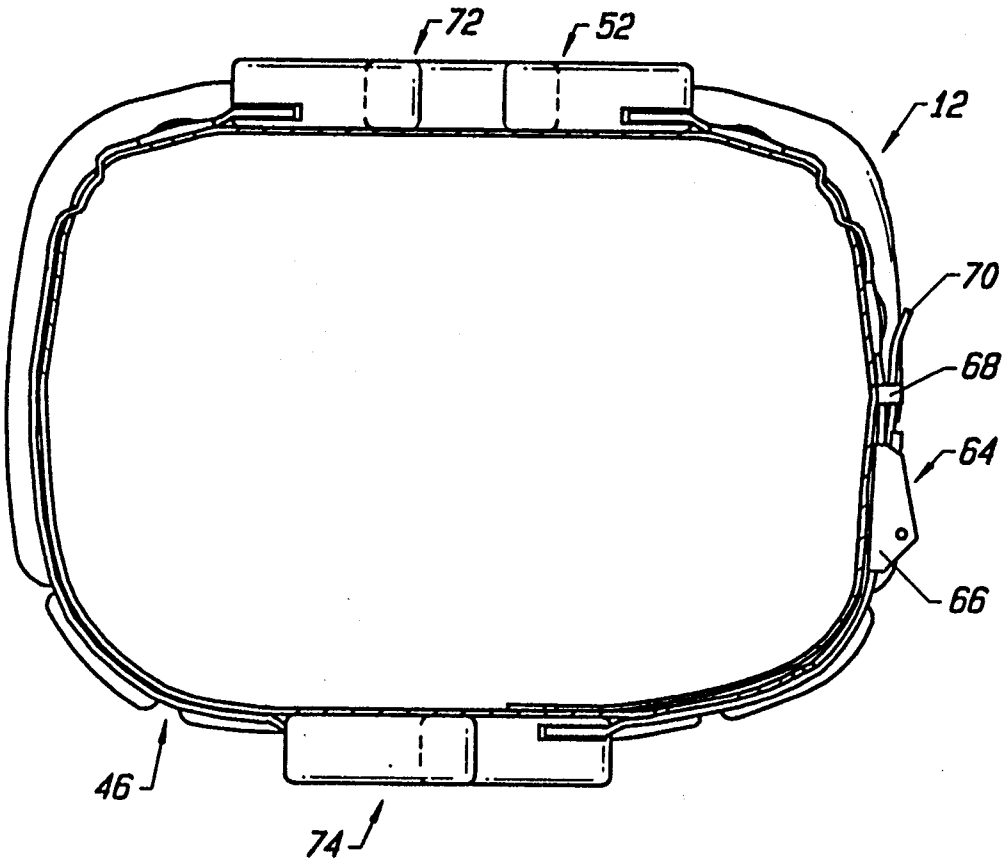
FIG. 4 is a sectional view of the device along line 4—4 of FIG. 1 in which the fastening means forms the device of FIG. 1 into a closed loop, without illustration of outer surface characteristics of the base member.

With reference to FIGS. 4 and 5, it may be observed that unit 46 may be formed into a closed loop by the use of clasp 66 and bitter end 70 of strap 38. With particular reference to FIG. 4, it should be seen that trio of weights 72 and pair of weights 74 lie at opposite portions of the loop formed. This arrangement is variable and more or fewer weights 52 may be employed, positioned front or back, depending upon the lumbar spinal orientation desired. FIG. 4 depicts device 10 without protuberance groups 34 and 36, for the sake of clarity. Turning to FIG. 5, the loop formed by unit 46 in FIG. 4 has been placed on a user 76 such that trio of weights 72 lies at the back portion and pair of weights 74 lies at the front portion thereof. It should be noted that various combinations of weights may be used in this regard.

In operation, the user fits base member 12 to the size of the user's girth by trimming end portions 26 and 28 as needed. Strap 38 is then passed through pair of slots 40. Plurality of weights 52 are then threaded onto strap 38 and are confined between clips or triglides 62. Weights 52 are at least partially positioned within recess portion 22 of base member 12. Strap 38 is then threaded through pair of slots 42 and fitted with further weights, such as pair of weights 74 between plurality of triglides 62. Further, triglides 62 may be threaded onto strap 38 to prevent slippage of strap 38 through pairs of slots 40 and 42. Unit 46 is then placed about the waist or girth of the user 76 and fastened using clasp 66, which urges padded base member 12 to the user 76. Plurality of weights 52 are placed in the front and rear positions of the user in such format. However, various weights and various configurations may be employed to distribute the weights as desired. It should also be noted that plurality of weights 52 may be oriented such that the large portion of each weight's eccentric shape is either upwardly or downwardly disposed. Thus, further adjustments may be made in the vertical direction relative to strap 38 by this expedient.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A body conditioning device worn about the waist comprising:

a. a base member possessing a first surface and a second surface, said base member including a padded core between said first and second surfaces, said first surface further including a recess portion;

b. a strap extendable along said first surface of said base member, said strap lying in the vicinity of said recess portion of said base member;

c. holding means for confining said strap to said base member to form a unit; and d. weight means for applying a force on said base member, said weight means including at least one weight carried by said strap and positioned to lie at least partially in said recess portion of said padded core, said at least one weight including a slot therethrough, said strap being threaded through said slot.

2. The device of claim 1 in which said weight means includes a plurality of weights carried by said strap at selected positions along said base member, each of said plurality of weights being positioned to lie at least partially in said recess portion.

3. The device of claim 2 in which said plurality of weights are eccentrically shaped, each weight possessing a large end portion and a small end portion, said plurality of eccentrically shaped weights being capable of nesting adjacent one another with the large end portion of one weight lying adjacent the small end portions of a neighboring weight.

4. The device of claim 3 in which said plurality of eccentric weights are each a triangular prism.

5. The device of claim 1 which additionally comprises fastening means to connect said unit to itself to form a closed loop.

6. The device of claim 1 which additionally comprises stop means for limiting travel of said at least one weight relative to said strap.

7. The device of claim 1 in which said base member includes at least one severable end portion.

8. The device of claim 1 in which said base member includes a widened portion between end portions thereof.

* * * * *